United States Patent [19]

Wachs et al.

[11] 4,144,867

[45] Mar. 20, 1979

[54] CONCRETE PILE-CUTTING MACHINE

[75] Inventors: Edward H. Wachs, Chicago; Horst Kwech, Gurnee, both of Ill.

[73] Assignee: The E. H. Wachs Company, Wheeling, Ill.

[21] Appl. No.: 837,835

[22] Filed: Sep. 29, 1977

[51] Int. Cl.[2] ..... B28D 1/04

[52] U.S. Cl. ..... 125/14; 51/241 B

[58] Field of Search ..... 82/4 C, 70.2; 51/241 B; 125/23, 14

[56] References Cited

U.S. PATENT DOCUMENTS

| | | | |
|---|---|---|---|
| 1,881,441 | 10/1932 | Fisher | 51/241 B |
| 2,271,582 | 2/1942 | Dixon | 82/4 C |
| 2,455,742 | 12/1948 | Dorian | 51/241 B |
| 2,581,479 | 1/1952 | Grasham | 51/241 B |
| 2,807,921 | 10/1957 | Dewing | 51/241 B |
| 4,044,749 | 8/1977 | Bowen | 125/23 R |

*Primary Examiner*—Harold D. Whitehead

*Attorney, Agent, or Firm*—Wegner, Stellman, McCord, Wiles & Wood

[57] ABSTRACT

A cutting machine for concrete piles and the like having an annular elongate frame positionable around a concrete pile, with first and second sets of guide members in spaced-apart relation to align the frame with the pile, first and second sets of movable clamps for locking the frame to the concrete pile, annular track means on the frame and a cutter head with drive means movably mounted on the annular track means and having a cutter-carrying arm movable across the top of the frame to engage the wall of the concrete pile.

8 Claims, 9 Drawing Figures

160
162
161
100
163
5.
101
14
178
110
147
131
177
132
130
4.
103
179
4.
13
140
102
176
148
133
145
146
149
175
5.

15
140
13
15
102
140
105
105
136
121
121
145
140
140
135
120
110
133
120
149
134
100
112
148

101
102
103
14
13
12
11
30
31
32
33
34
35
36
22
71
75
76
77
78
79
80
81
82
85
86
9.
9.

CONCRETE PILE-CUTTING MACHINE

BACKGROUND OF THE INVENTION

This invention pertains to a pile-cutting machine for cutting tubular piles of reinforced concrete by placement of the cutting machine on a concrete pile in situ.

Recent technology includes the use of preformed, tubular piles formed of reinforced concrete which can be driven into the ground and normally beneath the surface of a body of water as supports for pipelines, bridges, and the like. The concrete piles may come in different lengths. However, the upper surfaces thereof may not be at a desired elevation after being driven into the ground.

The cutting of pipe by a travelling pipe cutter is known in the art, as shown in the Levey U.S. Pat. No. 2,291,395. The prior art has not had a cutting machine with the capability of cutting piles of tubular reinforced concrete with a frame that could be placed in surrounding relation to a concrete pile in situ and aligned and locked thereto to provide a support for a travelling cutter mounted on track means supported by the frame and having the operative features of the structure disclosed herein.

SUMMARY OF THE INVENTION

A primary feature of the invention disclosed herein is to provide a cutting machine for reinforced concrete tubular piles which may be associated with a pile for cutting the pile to a desired height and which has an annular frame with means thereon for accurately locating and locking the frame to the concrete pile with power-driven cutter means carried by the frame and operable to travel around the concrete pile and cut through the wall thereof.

An object of the invention is to provide a concrete pile-cutting machine having the aforesaid structure with the guiding being accomplished by first and second sets of guide members which are in vertically-spaced relation and with the locking means including first and second vertically-spaced sets of movable clamps mounted on the frame to engage against the concrete pile and lock the frame in position. The guide members and clamps are adjustable and movable to permit easy placement of the machine frame on the pile, followed by accurate aligning and locking of the frame to the concrete pile.

Still another object of the invention is to provide a cutting machine, as set forth in the preceding paragraphs, wherein the frame supports annular track means adjacent the upper end thereof including upper and lower track members of circular configuration with a cutter head having tracking rollers for guiding the cutter head along the annular track means and drive structure including an endless chain with a loop therein mounted to the frame. Guide and drive sprocket structure carried on the cutter head tracks along the chain and moves the cutter head along the annular track means.

Other objects of the invention are to provide a pile-cutting machine with structural features enabling the use of the same frame with different diameter concrete piles, a structural relation of guide members and clamps including locating and spacing thereof to assure accurate aligning of the frame to the concrete pile, and a general assembly of structure resulting in a relatively lightweight and sturdy machine.

DESCRIPTION OF THE PREFERRED EMBODIMENT

Figure 1:
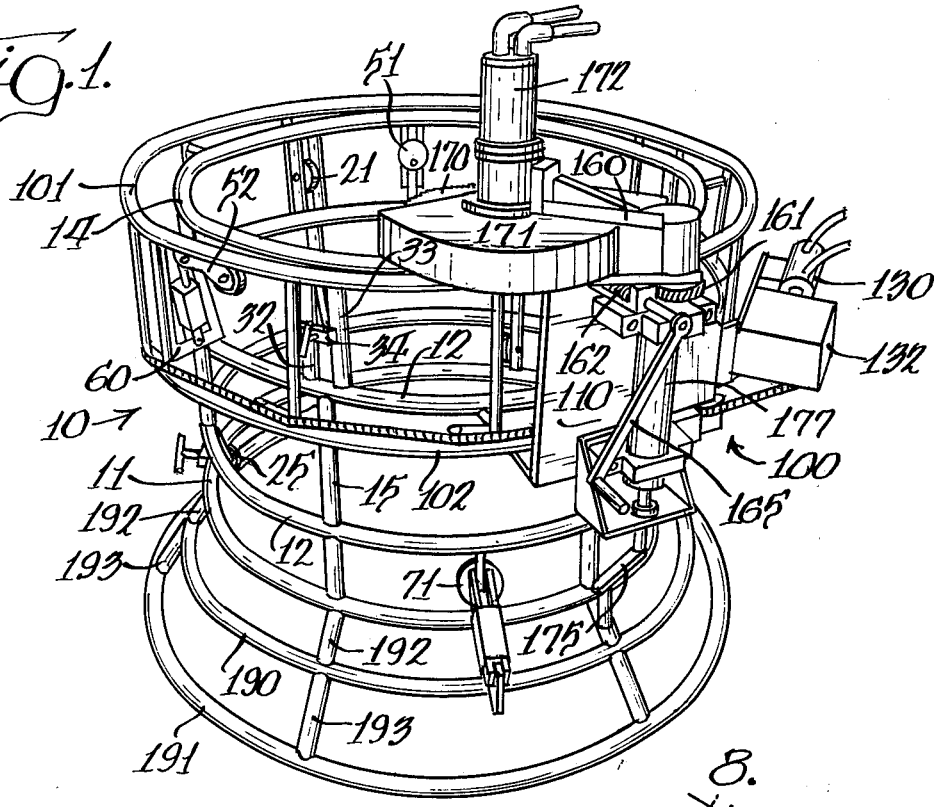
FIG. 1 is a perspective view of the cutting machine.

The pile-cutting machine is shown generally in FIG. 1 having a frame, indicated generally at 10, which is of an annular, elongate, open-ended configuration and has a series of vertically-spaced tubular members 11, 12, 13, and 14 of circular configuration and of the same diameter which are interconnected by lengths of vertical rods, such as indicated at 15, to define a basic cylindrical frame. The frame fits around a concrete pile having a slightly smaller diameter by placement of the frame downwardly over the top of a concrete pile in situ as, for example, driven into the ground beneath a body of water.

The frame 10 is located on a pile by structure including upper and lower sets of guide members in the form of guide rollers which are equidistantly spaced apart in each set. The arrangement is shown particularly in FIG. 2 wherein the upper set of guide members includes a pair of fixed guide rollers 20 and 21 and an adjustable guide roller 22, to define, in effect, a three-point contact with the exterior of a concrete pile. The lower set of guide members includes the fixed guide rollers 23 and 24 and an adjustable guide roller 25, not seen in FIG. 2 because of being generally disposed beneath the cutter structure.

Figures 8, 9:
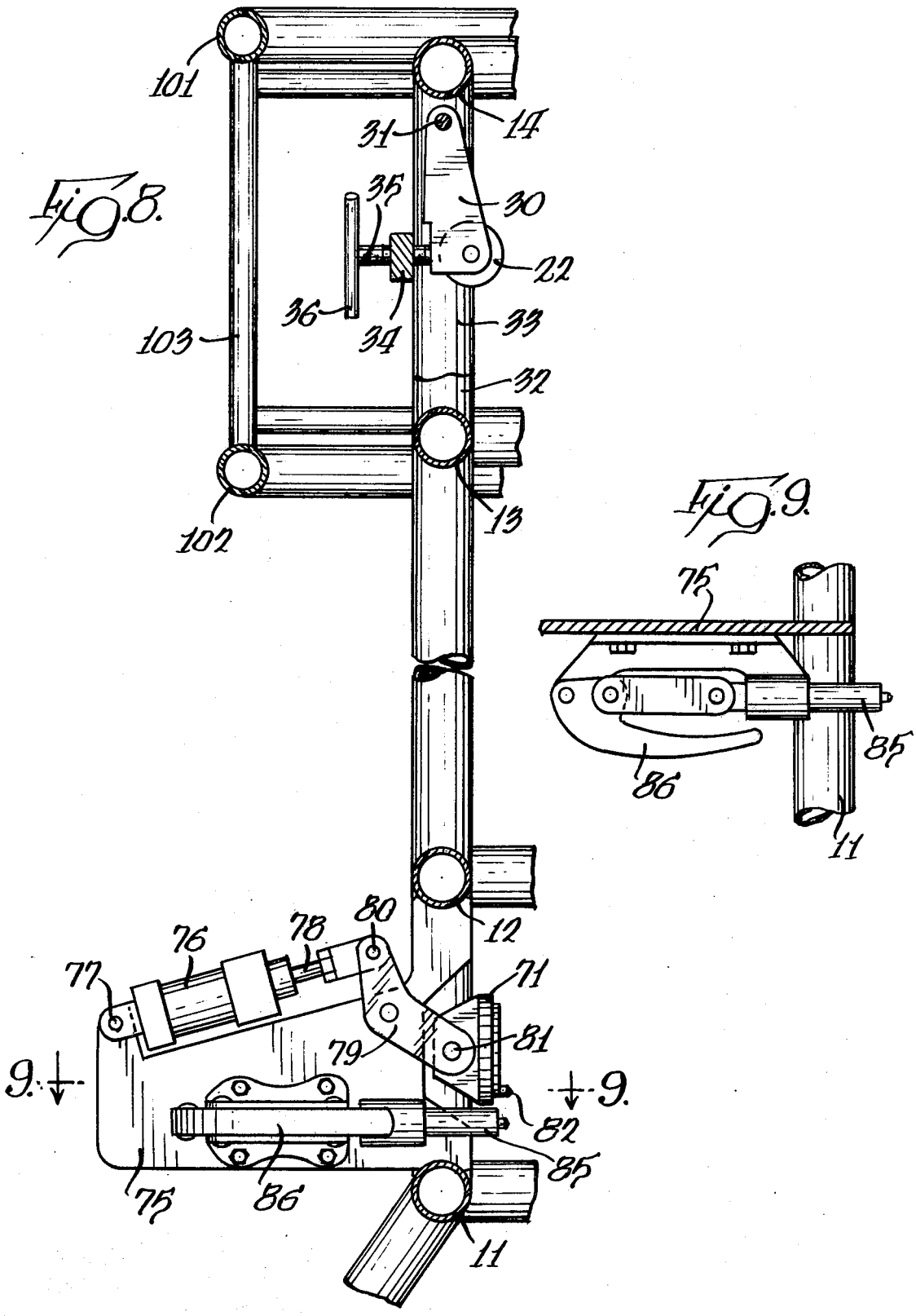
FIG. 8 is a vertical section, taken generally along the line 8—8 in FIG. 2.
FIG. 9 is a section, taken generally along the line 9—9 in FIG. 8.

Referring particularly to FIGS. 1 and 8, the upper adjustable guide roller 22 is shown as carried by an arm 30 pivoted at an upper end by means of a headed pin 31 extended between a pair of frame posts 32 and 33 and with a plate 34 spanning said posts and threadably receiving a rotatable member 35 having a handle 36 whereby the extension of the guide roller 22 may be controlled and with the weight of the roller and arm 30 causing the structure to follow the position of the threaded member 35.

Figure 6:
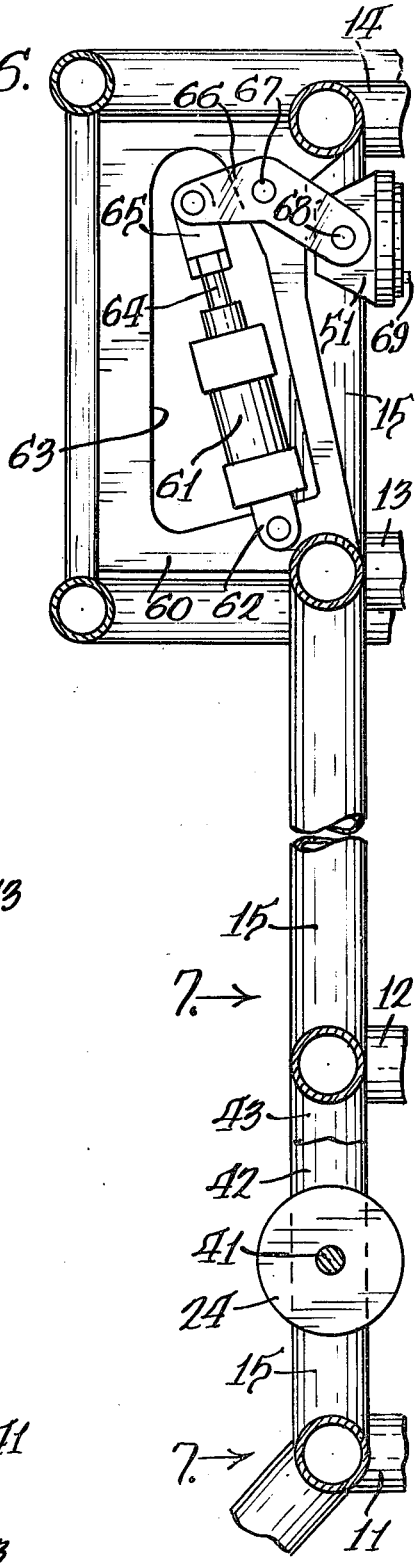
FIG. 6 is a vertical section, taken generally along the line 6—6 in FIG. 2.
Figure 7:
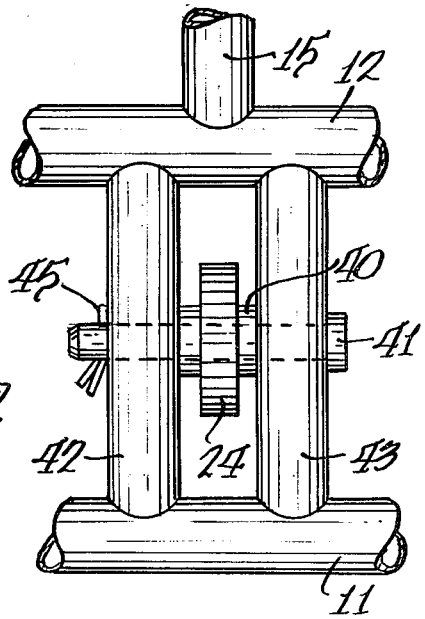
FIG. 7 is a vertical section, taken generally along the line 7—7 in FIG. 6.

A fixed guide roller is mounted as shown with respect to the lower fixed guide roller 24 in FIGS. 6 and 7, with the guide roller having an integral collar 40 rotatably mounted on a headed pin 41 extended through openings in a pair of support posts 42 and 43 extended between the frame members 11 and 12. The headed pin 41 is removably held in position by a cotter pin 45 whereby the structure may be readily disassembled to enable use of fixed rollers of a different diameter if the machine is to be associated with a concrete pile of a different diameter. The adjustable roller 22 and arm 30 may be similarly changed.

With the guide structure described, it will be seen that the upper and lower adjustable guide rollers 22,25 may be retracted to provide some degree of freedom of movement and the machine frame 10 may then be aligned above a concrete pile and lowered onto the pile. After lowering into approximate position, the adjustable roller 22 of the upper set as well as the adjustable roller 25 of the lower set of guide members are advanced to provide vertically-spaced levels of three-point contact for good alignment of the frame with the concrete pile. Although not described in detail, it will be noted that the adjustable roller 25 of the lower set is of the same construction as the upper adjustable roller 22 and associated structure and that the upper fixed rollers 20 and 21 are mounted similarly to the mounting shown for the lower fixed roller 24 in FIGS. 6 and 7.

Figure 2:
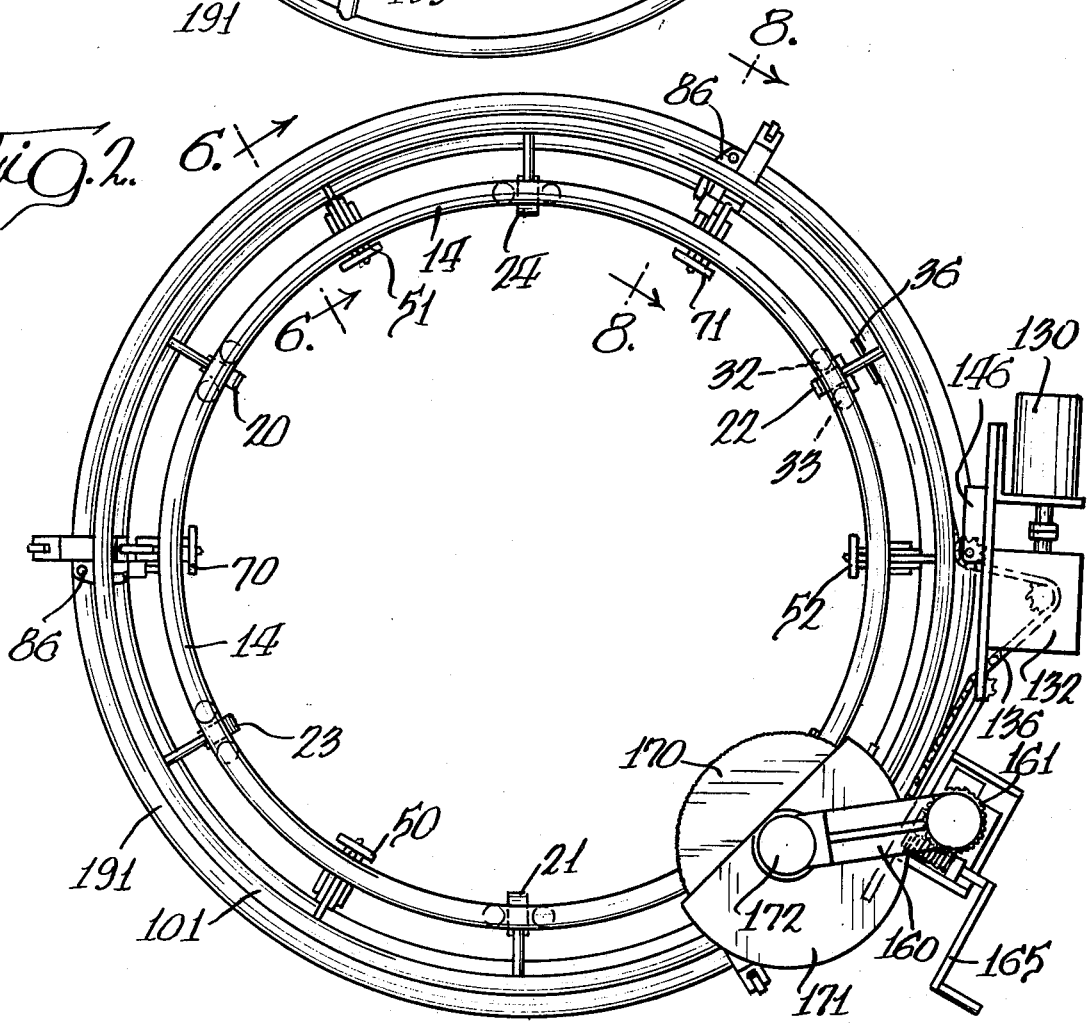
FIG. 2 is a plan view thereof.
Figure 3:
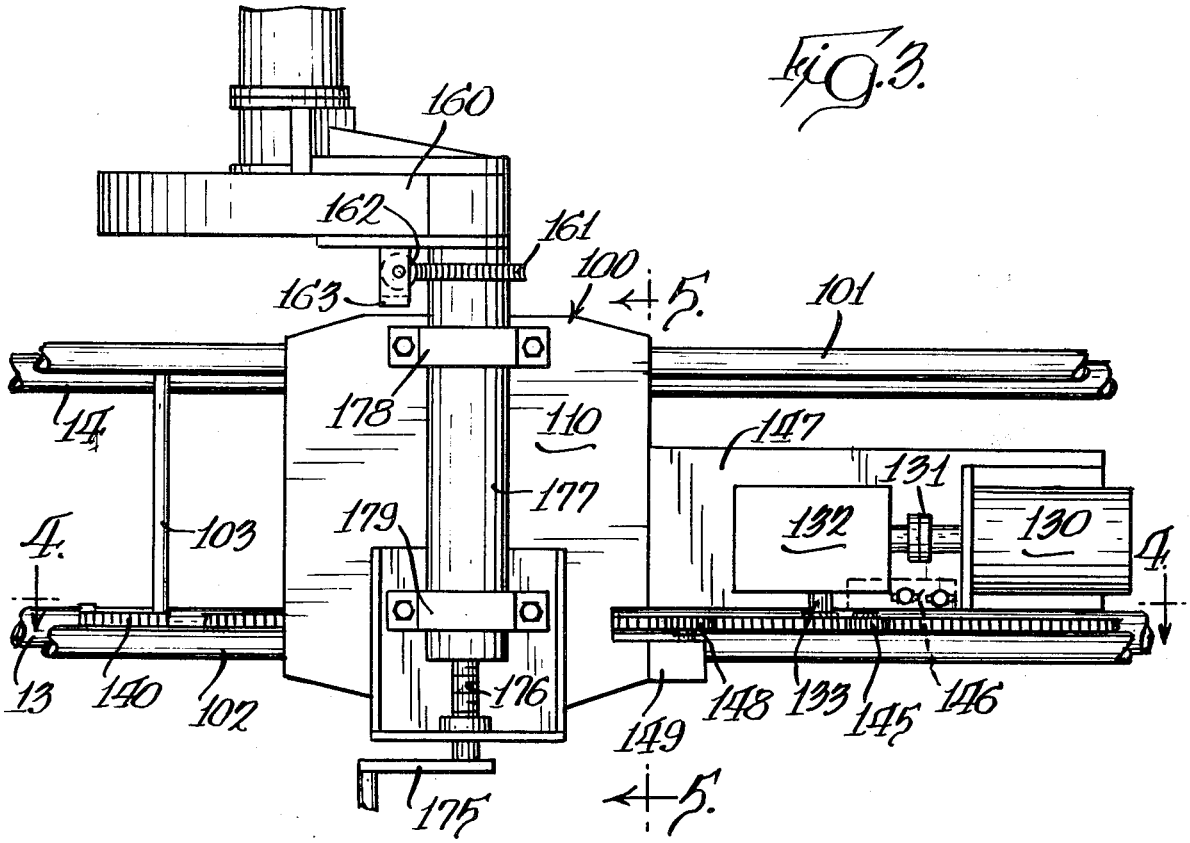
FIG. 3 is a fragmentary side elevational view of a part of the machine showing the cutter head and associated structure.

After location of the frame on a concrete pile, it is then locked into fixed relation with the concrete pile at a level beneath the upper end thereof by actuable clamp structure including two vertically spaced sets of clamps having fluid motors associated therewith. The upper set of clamps includes the clamps 50, 51, and 52 arranged equidistantly apart, as shown in FIG. 2. The structure of these three clamps is the same, with the structure of one being shown particularly in FIG. 6. An upright mounting plate 60 is secured to the machine frame and carries a fluid cylinder 61 having a bifurcated pivot connection 62 to the frame and having the body thereof disposed within an opening 63 of the mounting plate. A rod 64 is connected by pivot coupling 65 to an arm of a bell crank 66 pivoted at 67 to the mounting plate and with the other arm of the bell crank pivotally mounting at 68 the pad 51 having a biting tooth 69. The piston rod 64 may move between the extended position for retraction of the pad 51, as shown in FIG. 6, and be retracted from the position shown to extend the pad outwardly.

The lower set of clamps is arranged equidistantly around the frame and includes the clamps having the pads 70 and 71 with the third pad not being visible in the Figures. A mounting plate 75 for the clamp having the pad 71 is secured to the frame and has a fluid cylinder 76 pivotally connected at one end by a bifurcated connection 77 and with a piston rod 78 connected to a bell crank 79. One arm of the bell crank is pivotally connected to the piston rod at 80 and the other arm thereof is pivotally connected to the pad 71 at 81. As shown in FIG. 8, the piston rod is extended to have the pad 71 and a tooth 82 carried thereby retracted and with retraction of the piston rod the clamp pad 71 is moved outwardly against the concrete pile. Each of the three clamps is of the same structure and mounting. A suitable hydraulic circuit connects all six clamps for simultaneous actuation. The mounting plate 75 additionally carries a manually operable clamp rod 85 which can be moved between extended and retracted positions by means of a handle 86 to assure clamping of the frame on the concrete pile and retention of the frame in desired position, to assure against failure of the hydraulic system.

With the structure described, the frame of the pile-cutting machine may be transported to a position above and in alignment with a concrete pile by a boom or other suitable structure connected to one or more hooks on the frame and the frame is then lowered into surrounding relation with the concrete pile, with the upper and lower adjusted guide rollers retracted. When the frame reaches the desired level on the concrete pile, the adjustable rollers 22 and 25 are extended to obtain accurate alignment of the frame on the concrete pile because of the three-point contact at two vertically-spaced levels of the frame. When this is done, the upper and lower sets of clamps may be actuated simultaneously through the hydraulic circuit connections thereto to cause the clamping pads to engage and bite into the concrete pile to lock the frame in position and the manual clamps may be extended by movement of the associated handles 86 to assure retention of the frame at a desired elevation on the concrete pile. The location is done by the guide members and the clamps may move until they make firm contact.

A cutter head, indicated generally at 100, (FIGS. 1, 3, 4, and 5) is mounted for movement to travel around the outside of the frame in a circular path by annular track means including an upper track 101 and a lower track 102 which are interconnected at spaced locations by vertically-extending rods 103 and which are supported from the frame by vertically-spaced, horizontally-disposed rods 104 and 105 positioned at various locations around the frame and extended between the frame and the vertical posts 103.

The upper and lower tracks 101 and 102 have upper and lower sets of tracking rollers associated therewith and carried by the cutter head for guiding movemet of the cutter head along the tracks. A base plate 110 of the cutter head has a pair of laterally-extending brackets 111 and 112 in vertically-spaced relation, with the upper plate 111 carrying the upper sets of tracking rollers 115 and 116 which engage opposite sides of the upper track 101 at two locations. The lower plate 112 has the two sets of tracking rollers 120 and 121 carried thereon which extend upwardly and engage opposite sides of the lower track 102 at two locations. The cutter head 100 is propelled along the annular track means by a drive unit including a fluid motor 130 having a drive input into a gearbox 132 having a depending output shaft 133 with a drive sprocket 134 thereon. The drive sprocket engages within a loop 135 of an endless chain 136 extended around the annular track means and held in fixed relation thereto by a series of toothed gear segments 140 positioned equidistantly around the perimeter of the annular track means and secured to the upper side of the lower track 102. In the pile-cutting machine shown and only as an example, there would be twelve of the segments 140 equidistantly spaced around the frame of the machine.

Figure 4:
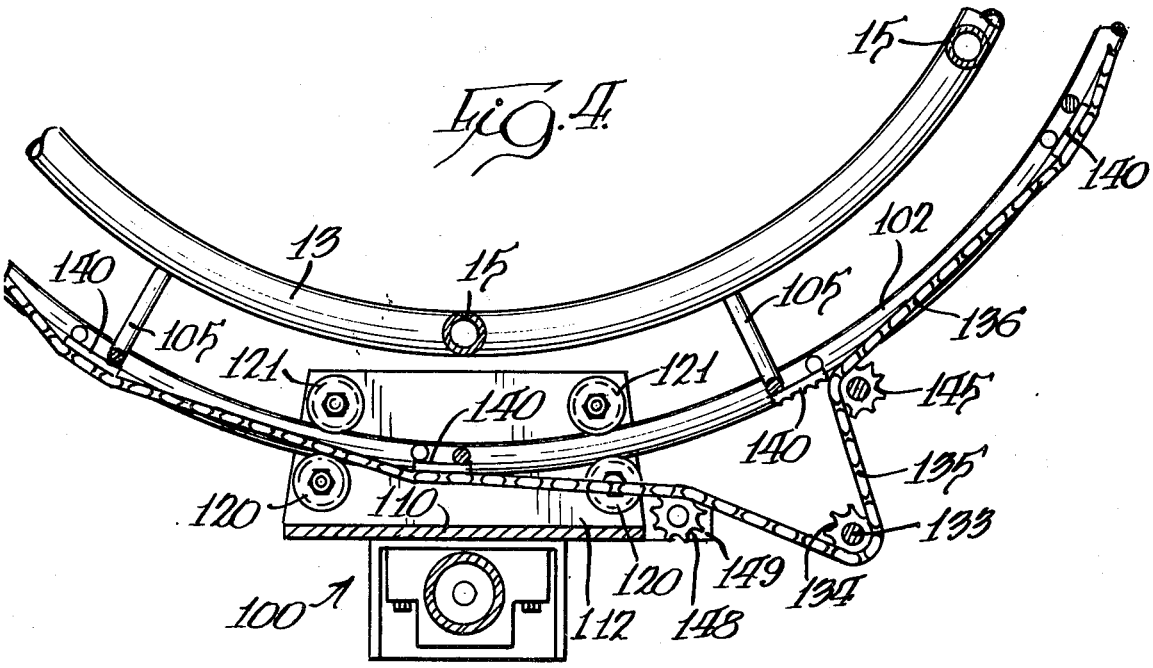
FIG. 4 is a sectional view, taken generally along the line 4—4 in FIG. 3.
Figure 5:
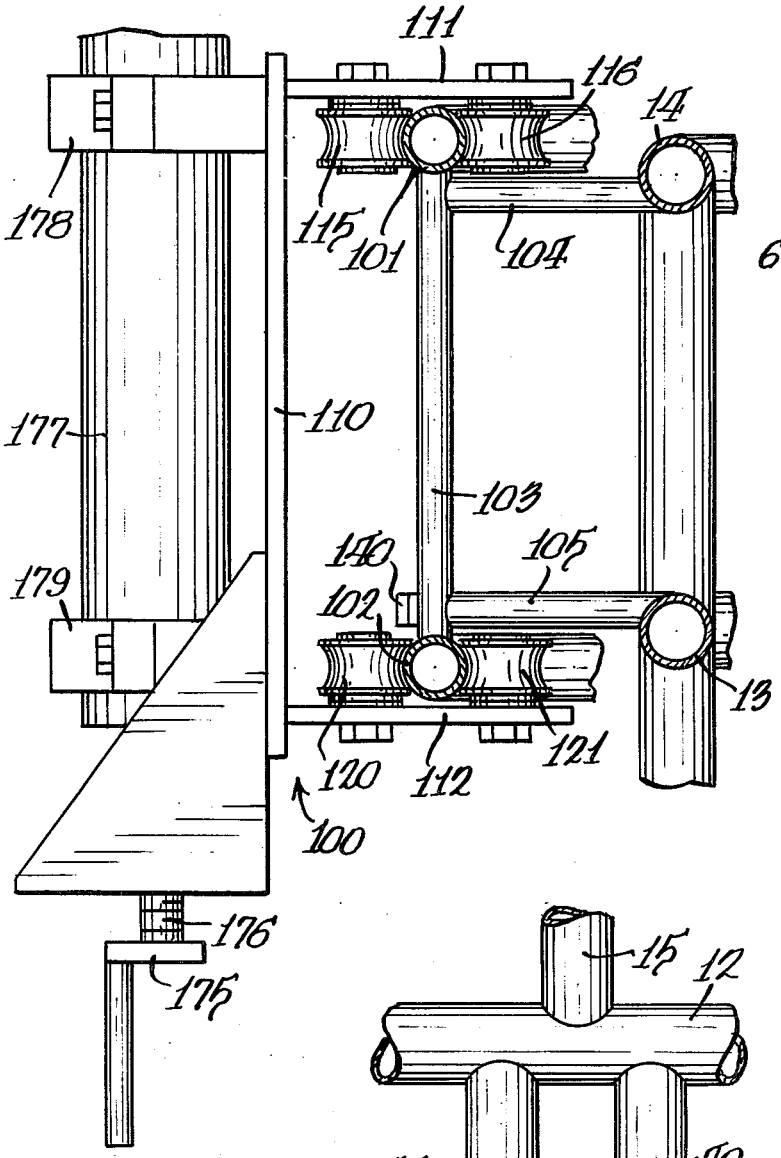
FIG. 5 is a vertical section, taken generally along the line 5—5 in FIG. 3.

The endless chain 136 has a length slightly greater than the length of the lower track 102 in order to provide the chain loop 135 shown in FIG. 4. The loop 135, in effect, travels around the frame of the machine along with the cutter head 100 and is defined, in part, by an adjustable sprocket 145 carried on an adjustable plate 146 on an extension plate 147 of the cutter head. Additionally, there is a guide sprocket 148 extending upwardly from a plate 149 secured to the base plate 110 of the cutter head. The adjustable guide sprocket 145 is spaced from the gear segments 140 a sufficient distance whereby as the cutter head travels around the annular track means, there is no interference between the teeth of the sprocket 145 and the teeth of a gear segment 140 which the sprocket is passing.

With fluid power supplied from motor 130, the drive sprocket 134 is caused to rotate and advance along the sprocket chain to move the cutter head 100 which causes the chain loop 135 to progress around the machine frame.

The cutter head has an arm 160 mounted thereon for rotation about a vertical axis, with rotation thereof being controlled by a worm wheel 161 rigidly connected to the arm and a worm 162 mounted in a bracket 163 carried on the cutter head. The worm 162 has a crank arm 165 connected thereto whereby manual rotation of the crank causes the arm 160 to move between retracted and extended positions across the top of the frame. The arm 160 carries a saw blade 170 partially enclosed by a guard housing 171 and driven from a fluid motor 172 carried by the arm.

The vertical location of the saw blade 170 can be controlled by means of a crank 175 connected to a threaded member 176 which engages the underside of a post connected to the arm 160 and rotatably mounted within a housing 177 secured to the face plate 110 by brackets 178 and 179.

The location and locking of the frame to a concrete pile has previously been described. With the cutting structure just described, it will be evident that following locking of the frame on a concrete pile, any desired change in elevation of the saw blade 170 may be made by turning the crank 175 and, as the cutter head is caused to move along the annular track means by energization of the fluid motor 130, the saw blade 170 may be advanced into the wall of the concrete pile by turning the crank 165 and with the saw blade rotating under the power of the fluid motor 172. The depth of cut into the wall of the pile may be gradually increased by operation of the crank 165 until the entire wall, including reinforcing rods that may be therein, have been cut to permit removal of an unwanted upper part of the concrete pile and leaving the remaining concrete pile in situ at the desired elevation.

For stability of the pile-cutting machine when not in use, the frame is provided with a base including upper and lower annular rods 190 and 191 of increasing diameter and of a diameter greater than the frame rods 11–14. These annular rods are interconnected by rod sections 192 and 193 spaced around the base. With this structure, a base is provided of a diameter to provide a stable support for the machine when resting on the ground or other surface.

We claim:

1. A pile cutting machine for concrete piles and the like comprising, an annular elongate open-ended frame with fixed integral members having an interior opening of a size to receive a concrete pile therein and with said frame in surrounding relation thereto, first and second sets of guide members on said frame with said sets being vertically spaced apart, said first set being at the lower end of the frame to initially align the frame relative to the concrete pile as the frame is lowered into surrounding relation therewith and said second set being adjacent the upper end of the frame to coact with the first set and guide the frame for lowering movement along the concrete pile, first and second sets of movable clamps mounted on said frame with said sets being vertically spaced apart to engage against said concrete pile and hold said frame in position, annular track means on said frame, a cutter head movably mounted on said annular track means, and means for propelling said cutter head along the annular track means.

2. A machine as defined in claim 1 wherein each of the sets of said guide members comprises three guide rollers positioned substantially equidistantly around said frame to make contact with the concrete pile at three locations, and at least one of said rollers being adjustable.

3. A machine as defined in claim 2 wherein said rollers are removably mounted on said frame whereby different size rollers may be used to adopt the frame for different diameter concrete piles.

4. A machine as defined in claim 1 wherein a set of said movable clamps comprises three clamps positioned substantially equidistantly around said frame to engage against the concrete pile at three locations.

5. A machine as defined in claim 4 wherein each of said movable clamps includes a bell crank pivoted to the frame, a pad pivotally mounted to an arm of the bell crank, and an actuating fluid motor connected between said frame and the other end of the bell crank.

6. A cutting machine for cutting tubular reinforced concrete piles comprising: a frame formed of interconnected frame members including horizontally disposed integral members of circular shape in vertically-spaced relation to form a cylindrical opening to fit onto a concrete pile in situ by placement over the top thereof; two vertically-spaced sets of guide rollers engageable with the concrete pile with the lower set guiding the frame onto the concrete pile and both sets thereafter guiding the frame along the concrete pile, each set comprising three guide rollers; vertically-spaced sets of actuable clamps on said frame for locking the frame to the concrete pile; annular track means adjacent the upper end of said frame including upper and lower tracks spaced from and in surrounding relation to the frame; a cutter head located completely outside said cylindrical opening for non-interfering relation with said concrete pile during placement of the frame on the concrete pile having sets of opposed tracking rollers positioned at opposite sides of a track for holding the cutter head to said annular track means; drive means for said cutter head including an endless chain mounted in surrounding relation to said frame, means on said cutter head for forming a chain loop, and a driven sprocket on the cutter head engageable with said chain loop; and a cutter-carrying arm pivotally mounted on said cutter head for movement across the top of said frame to move the cutter into the concrete pile.

7. A machine as defined in claim 6 having a circular member of a diameter greater than the horizontally disposed members of the frame is secured to the lower end of the frame to provide a support base for the machine.

8. A machine as defined in claim 6 wherein a set of said guide rollers comprises three guide rollers positioned substantially equidistantly around said frame to make contact with the concrete pile at three locations, and at least one of said rollers being adjustable and a set of said movable clamps comprises three clamps positioned substantially equidistantly around said frame to engage against the concrete pile at three locations.

* * * * *